US006334349B1

(12) United States Patent
Rolf

(10) Patent No.: US 6,334,349 B1
(45) Date of Patent: Jan. 1, 2002

(54) METHOD FOR THE MANUFACTURING OF A SHAFT WITH A LARGER DIAMETER FLANGE

(75) Inventor: Bernhard Rolf, Hasewinkel (DE)

(73) Assignee: Leico GmbH & Co. Werkzeugmaschinenbau, Ahlen (DE)

( * ) Notice: Subject to any disclaimer, the term of this patent is extended or adjusted under 35 U.S.C. 154(b) by 0 days.

(21) Appl. No.: 09/656,757

(22) Filed: Sep. 7, 2000

(30) Foreign Application Priority Data

Sep. 28, 1999 (DE) ..... 199 46 508

(51) Int. Cl.[7] ..... B21D 22/00

(52) U.S. Cl. ..... 72/84; 72/85; 72/95; 72/98; 72/342.94; 72/377

(58) Field of Search ..... 72/71, 82, 84, 72/85, 86, 95, 96, 98, 342.04, 377

(56) References Cited

U.S. PATENT DOCUMENTS 3,632,273 A * 1/1972 Savickas ..... 72/84
4,173,876 A * 11/1979 Schaefer ..... 72/83
4,238,944 A * 12/1980 Duffy ..... 72/84
5,987,952 A * 11/1999 Kutzscher et al. ..... 72/71
6,105,410 A 8/2000 Säuberlich et al.

FOREIGN PATENT DOCUMENTS

| | | | |
|---|---|---|---|
| DE | 42 25 364 A1 | 2/1994 | |
| DE | 195 32 519 C2 | 3/1997 | |
| DE | 198 49 981 A1 | 4/1999 | |
| EP | 0 222 929 A1 | 5/1987 | |
| JP | 59-42138 * | 3/1984 | ..... 72/84 |

* cited by examiner

*Primary Examiner*—Ed Tolan
(74) *Attorney, Agent, or Firm*—Oblon, Spivak, McClelland, Maier & Neustadt, P.C.

(57) ABSTRACT

The invention relates to a method for the manufacture of a shaft with a larger diameter flange, particularly for a cone gear, a round stock as the workpiece being rotated about its longitudinal axis relative to at least one spinning roll and is axially compressed and the material occurring during axial upsetting is formed to the larger diameter flange under the action of the at least one spinning roll. The invention also relates to a cone gear.

6 Claims, 7 Drawing Sheets

METHOD FOR THE MANUFACTURING OF A SHAFT WITH A LARGER DIAMETER FLANGE

FIELD OF THE INVENTION

The invention relates to a method for the manufacture of a shaft having a larger diameter flange, particularly for a cone gear.

BACKGROUND OF THE INVENTION

A method is known from DE 195 32 519 C2, in which a step is formed on a shaft by flow-forming so as to give a larger diameter retaining flange. However, as a result of the method, flow-forming can only lead to relatively small diameter increases.

DE 42 25 364 A1 discloses so-called bore or hole spinning, in which punches are spun in a solid workpiece. For forming a hollow body spinning rolls and annular tools are infed and bring about an axial material flow, while preventing a diameter increase.

A cone gear is e.g. described in EP 222 929 A1. Two pulleys located on a shaft can be displaced axially with respect to one another so that as a result of the relative displacement a driving belt, such as a V-belt, can penetrate to a greater or lesser extent between the conical pulleys. Therefore the belt can engage with different diameters of the arrangement, so that it is possible to modify the transmission ratio of a belt pulley drive.

In the case of cone gears in general one pulley is firmly connected to a shaft, so that in particular it cannot be axially displaced. The other pulley is displaceable, so that an axial spacing change can take place.

Different methods are known for the manufacture of cone gears. It is, for example, conceivable to construct the pulley firmly connected to the shaft as a separate component and to fit it to the shaft using fastening means. The fixed pulley can also be connected to the shaft by a welding process. However, such multipart constructions of shaft and pulley are expensive to manufacture. In addition, the position of the arrangement joined by fastening means or the weld point is subject to stress during the operation of the gear as a result of the power transmission to or from the shaft, so that here again disadvantages arise. It is consequently appropriate to manufacture the arrangement constituted by the shaft and the fixed pulley in one piece. For this purpose forging or casting processes are usable, but are relatively complicated and expensive. In addition, the attainable maximum difference between a maximum and a minimum size power transmission diameter is greatly limited, particularly in the case of manufacture by a forging process.

SUMMARY OF THE INVENTION

Therefore the object of the invention is to so further develop a method of the aforementioned type that the arrangement of shaft and flange can be manufactured in a particularly economic manner, the flange diameter being variable over a wide range.

According to the invention this object is achieved in that a round stock as the workpiece is rotated about its longitudinal axis relative to at least one spinning roll and is upset in the axial direction and that the material displaced during axial upsetting is formed to the larger diameter flange under the action of the at least one spinning roll. The flow-forming process offers the possibility of constructing in one piece the arrangement of the shaft and flange, the flange in the case of a cone gear being used as a conical pulley, whilst also permitting a larger diameter variation with respect to the power transmission point of a gear. As a result of the axial upsetting of the starting workpiece the radial material flow is assisted in coordination with the action of the spinning roll. Even though the method is preferred for the manufacture of a part of a so-called cone gear, it can also be used for the manufacture of random shafts having a flange.

Preferably to the workpiece is infed at least one spinning roll pair with two spinning rolls, which are mutually axially spaced and the flange is formed between the two spinning rolls. This leads to a clearly defined, radial material flow, both sides of the flange to be formed being fixable with respect to their contour by contact with the particular spinning roll. For a particularly good power distribution it is possible to uniformly circumferentially distribute two, three or more spinning roll pairs.

The workpiece is preferably heated in the area in which the flange is formed and in particular to a temperature above the recrystallization point. As a result of the heating it is possible to perform the working process using lower forces. If a heating to above the recrystallization point takes place, a particularly stable, high quality worked product is obtained and working is not limited by a work hardening. The starting workpiece can be constituted by a solid rod or a pipe, in which during the working process a stiffening mandrel is introduceable into the pipe cavity.

Preferably use is made of one or more spinning rolls with a shoulder, one shoulder face engaging on an approximately axially directed outer circumference of the workpiece, whereas the other shoulder face passes approximately radially corresponding to the flange to be formed. Thus, the flange is formed on the radially directed shoulder face of the spinning roll, so that the flange shape can be determined by the choice of spinning roll. As a result of the approximately axially directed shoulder face there is a certain guidance of the particular spinning roll by the workpiece.

It can naturally be useful to use at least one spinning roll pair in which at least one spinning roll has a roughly disk-like or sleeve-like construction and if the axis of the disk-like spinning roll is approximately parallel to the longitudinal axis of the workpiece. The use of a disk-like spinning roll is preferred as a particularly simple variant of the method according to the invention. As a result of the parallelism of the roll axis and the workpiece axis, it is possible in simple manner to produce exactly radially oriented flange side faces.

It is particularly preferred if the two spinning rolls of the at least one spinning roll pair are axially fed in against one another for forming the flange. As a result of the axial infeed the material is axially displaced. The flow direction of the displaced material is determined by the joint action of the two rolls, so that the radially extending flange is produced in a clearly defined manner.

Appropriately the axial upsetting and infeeding movements of the at least one spinning roll are controlled in matched manner. As a result of a control a particularly good method sequence can be obtained, which is particularly useful for reducing product tolerances.

In accordance with the present invention, a displaceable cone pulley element is manufactured in one piece from an approximately disk-like starting workpiece by flow-forming. The advantages of the flow-forming of gear elements were described in conjunction with the manufacture of the flange firmly connected to the shaft. It is also advantageous that the entirety of the cone gear elements in question can be manufactured with the same basic method. This permits the use of the same materials and a comparable manufacturing technology. In addition to a disk segment it is possible to use as the starting workpiece a forging or casting, which has a certain preliminary shape.

Preferably at least the cylindrical circumferential wall section is flow-formed in a splitting-upsetting process from a radially directed portion of the starting workpiece. As a result of the splitting-upsetting process it is possible to bring about a comparatively large material quantity without the use of excessive forces with an overtravel of a splitting roll. This is economic and leads to particularly high quality workpieces.

Preferably the internal contour in the starting workpiece is formed by an externally toothed spinning chuck. The provision of the internal contour can consequently be integrated into the flow-forming method according to the invention for the manufacture of the displaceable cone pulley element.

Compared with the prior art, a cone gear according to the invention is characterized in that the shaft with the flange is manufactured according to a method or an advantageous development according to the invention or that the displaceable conical pulley element is manufactured according to a method or an advantageous development according to the invention. The inventive advantages of the method are consequently implemented in the cone gear. Particular reference is made to the simplicity of manufacture, the quality of the gear elements and the high transmission ratio of the gear.

The invention is based on the surprising finding that it is possible to manufacture a high quality cone gear by a flow-forming procedure. This is brought about in that the flow movement of the material necessary for forming a flange is assisted by an axial upsetting of the starting workpiece. It is also particularly stressed that all the gear parts described can be manufactured by a flow-forming procedure, so that the entire production process can take place with the same technology and consequently remains in the same hands. Obviously the invention is not restricted to elements of cone gears. For example, a shaft manufactured according to the invention with a flange can be used in various gears. In addition, the worked part produced need not be a shaft. It is in fact possible to manufacture random parts with a circumferential flange.

BRIEF DESCRIPTION OF THE DRAWINGS

The invention is described in greater detail hereinafter with reference to exemplified, preferred embodiments and the attached drawings, wherein show.

DETAILED DESCRIPTION OF PREFERRED EMBODIMENTS

Figure 1:
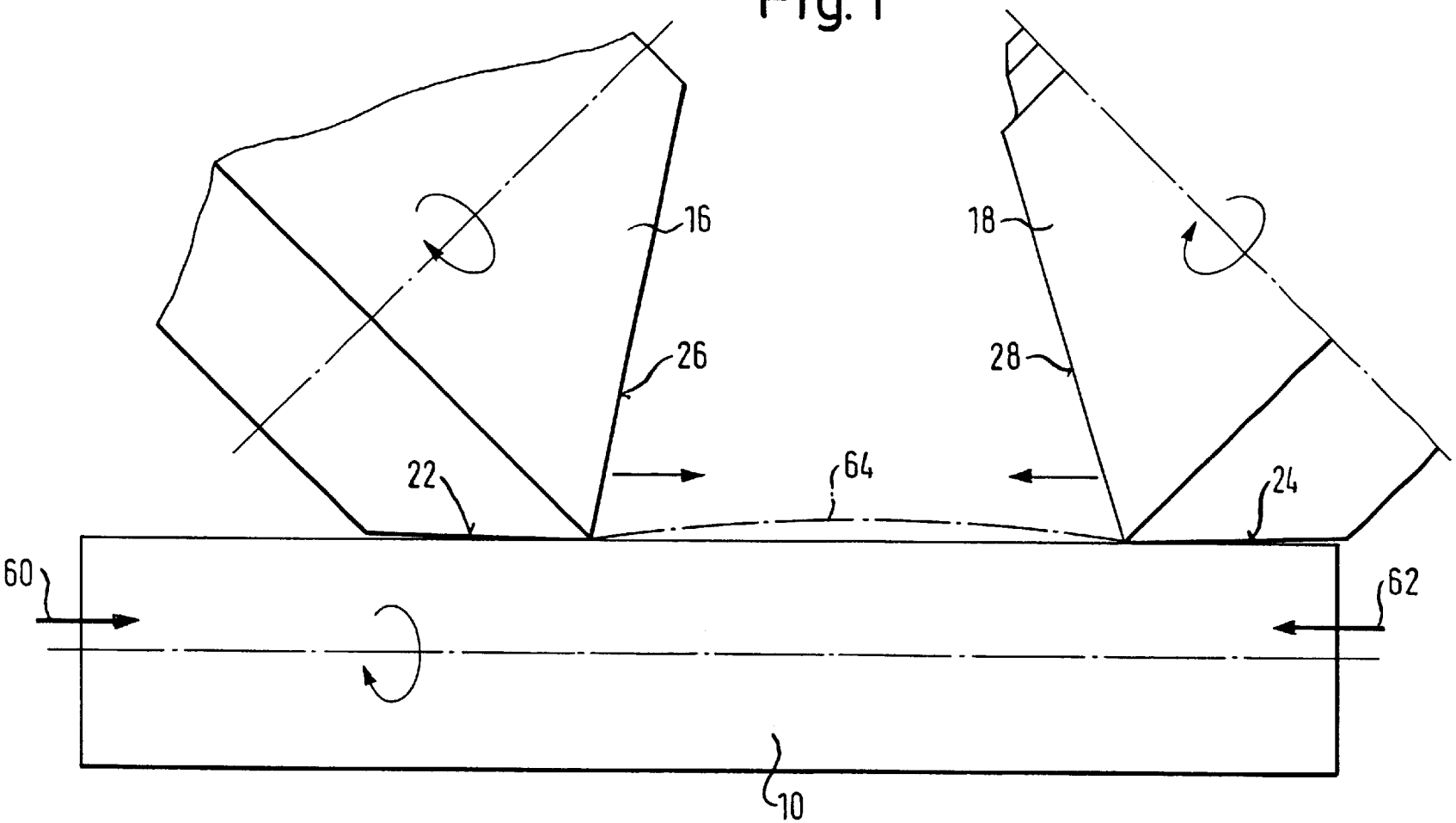
FIG. 1 shows an initial stage of a method according to the invention for the manufacture of a shaft with a larger diameter flange in a first embodiment.

FIG. 1 shows an initial stage in a method for the manufacture of a shaft with a larger diameter flange. A workpiece 10 in round stock form is rotated about its longitudinal axis, while two spinning rolls 16, 18 are infed. The workpiece 10 is upset, as is indicated by arrows 60, 62. The spinning rolls 16, 18 are axially moved towards one another. As a result the workpiece material flows radially, which is indicated in the diagram by the dot-dash line 64.

The spinning rolls in each case have two shoulder faces, one shoulder face 22, 24 engaging on the approximately axially directed outer circumference of the workpiece 10. The other shoulder faces 26, 28 of the spinning rolls 16, 18 extend radially.

Figure 1A:
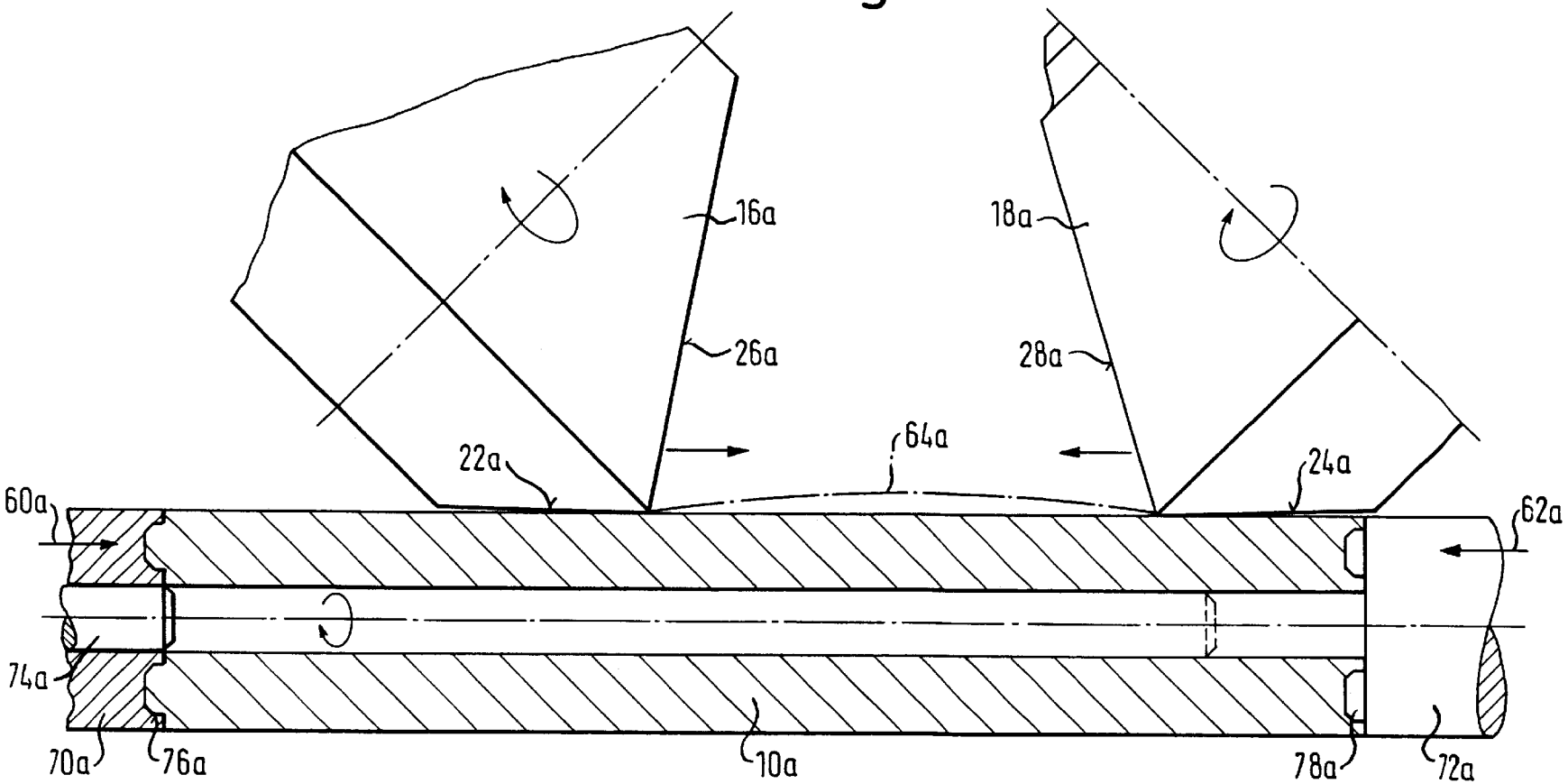
FIG. 1*a* illustrates a modification of the method, in which a tubular workpiece is worked.

A modification of the above-described method is shown in FIG. 1*a*, in which components having the same function and construction are given the same reference numerals followed by the letter a. Unlike in the method according to FIG. 1 the workpiece 10*a* is constituted by a pipe having an inner cavity. In order to prevent a deformation of the pipe cavity a stiffening mandrel 74*a* is introduced by one or both chucks 70*a*, 72*a*. The inserted stiffening mandrel 74*a* is represented by a broken line. On the front faces of the chucks 70*a*, 72*a* are provided profiles for forming an end profile on the workpiece. For this purpose depressions 76*a* are made on one chuck 70*a* correspondingly leading on the front face of workpiece 10*a* to raised profile, whereas on the other chuck 72*a* protuberances 78*a* are formed, correspondingly leading to depressions in the front face of workpiece 10*a*. Obviously the profiles on the chucks 70*a*, 72*a* can be modified at random in accordance with the desired shaping.

Figure 2:
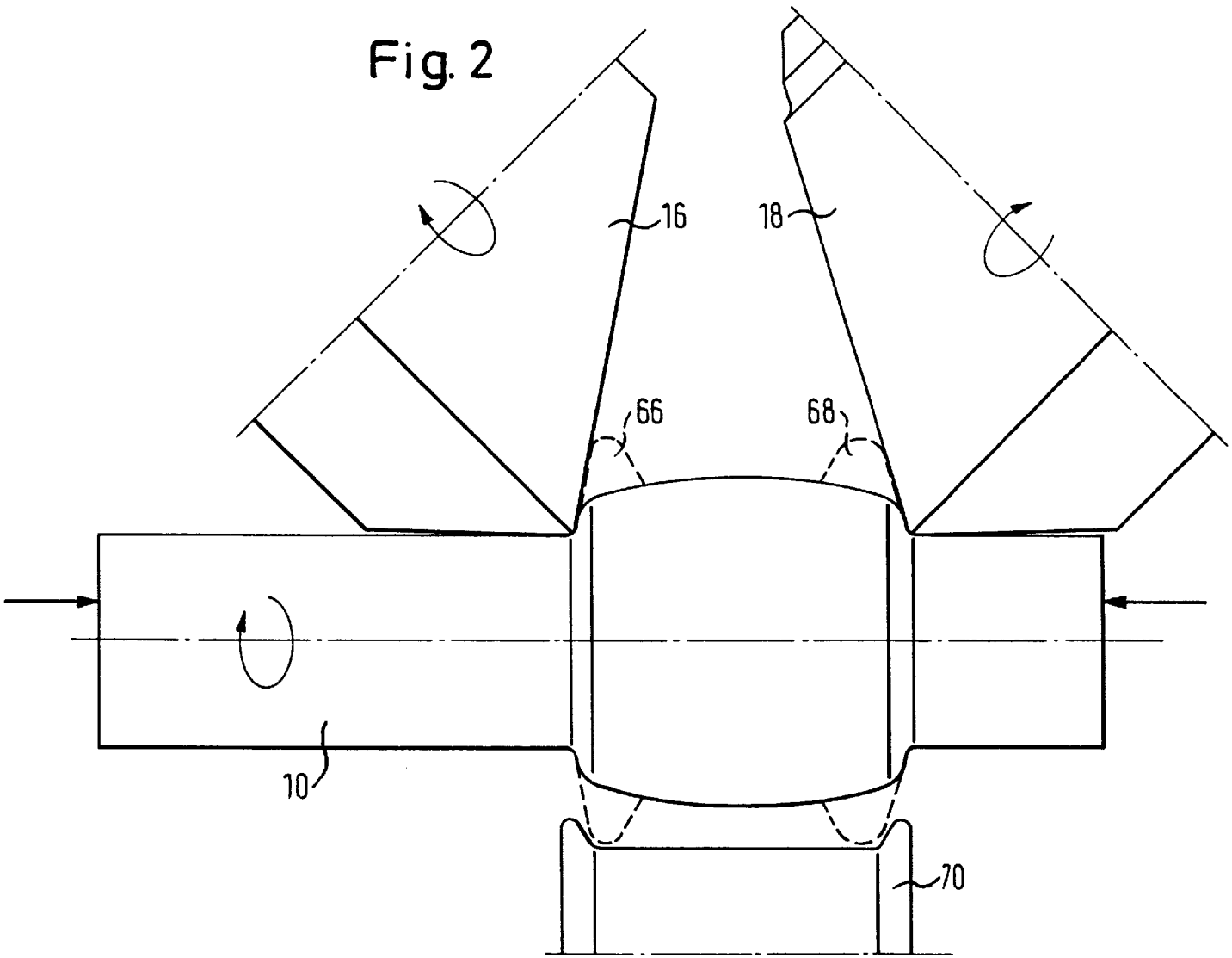
FIG. 2 shows an intermediate stage of the method according to FIG. 1.

FIG. 2 shows an intermediate stage of the method according to the invention. The spinning rolls 16, 18 have already been moved towards one another by a certain distance, so that a certain material quantity has been radially displaced into the area between the spinning rolls 16, 18. In order to avoid the formation of the humps 66, 68 represented by the interrupted lines, advantageously a further roll 70 is infed. This infeeding of the further roll 70 preferably and advantageously takes place at a position circumferentially offset with respect to the spinning rolls 16, 18. Externally the additional roll 70 is provided with projecting edges for limiting the material flow.

Figure 3:
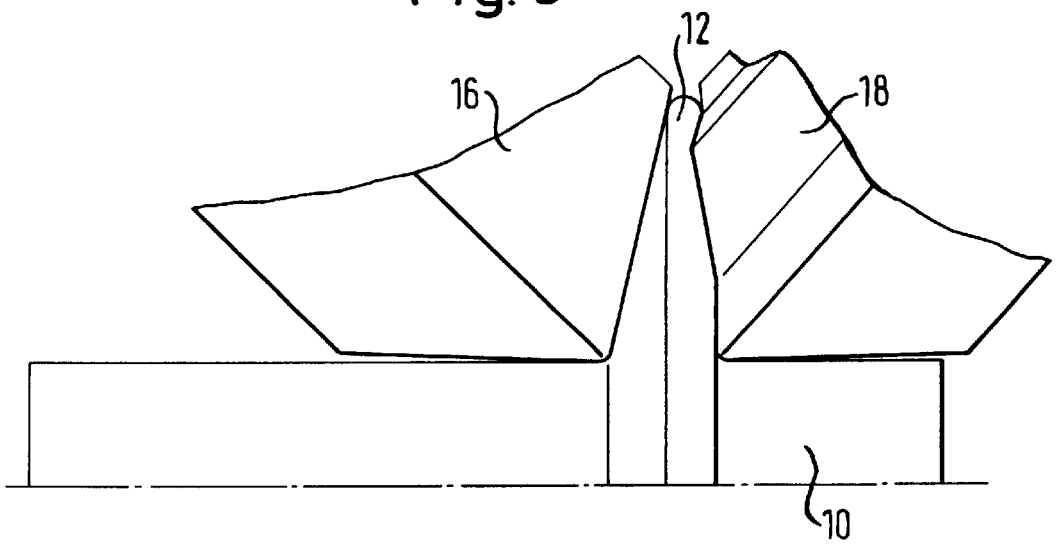
FIG. 3 illustrates a further advanced stage of the method according to FIG. 1.

FIG. 3 shows a more advanced method stage. The spinning rolls 16, 18 have been axially moved towards one another to the maximum or almost the maximum. The flange 12 has its final or almost final shape. On the left-hand side of flange 12 it is possible to see a conical contour, so that the structure produced from shaft and flange 12 can be used as a gear element of a cone gear.

Figure 4:
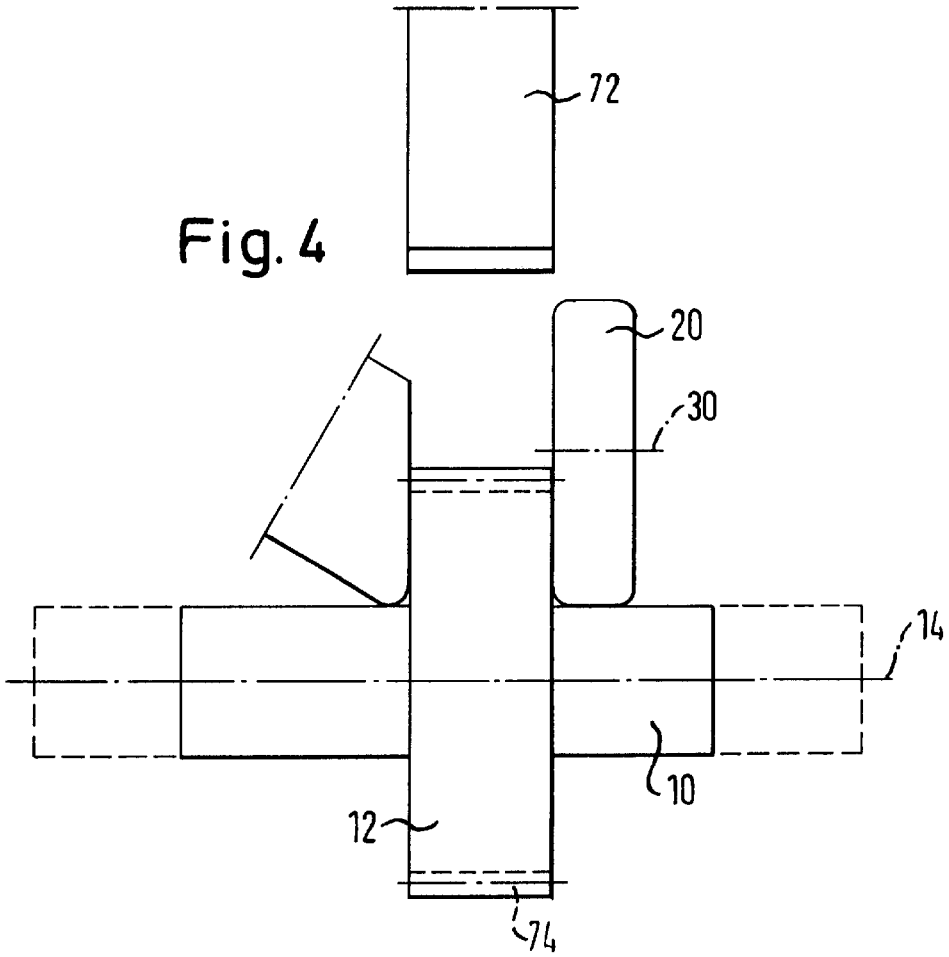
FIG. 4 shows an intermediate stage in a method for the manufacture of a shaft with a larger diameter flange in a second embodiment.

FIG. 4 shows an intermediate or final stage of a method according to a further embodiment of the present invention. One of the spinning rolls is constructed as a disk-like spinning roll 20, whose axis 30 is parallel to the workpiece axis 14. External teeth 74 are shaped in the flange 12 by means of a gear cutting roll 72, which can be usefully circumferentially displaced with respect to the spinning rolls 20. This leads to a gear part with a shaft, which carries an externally toothed flange, which is usable in numerous different ways.

Figure 4A:
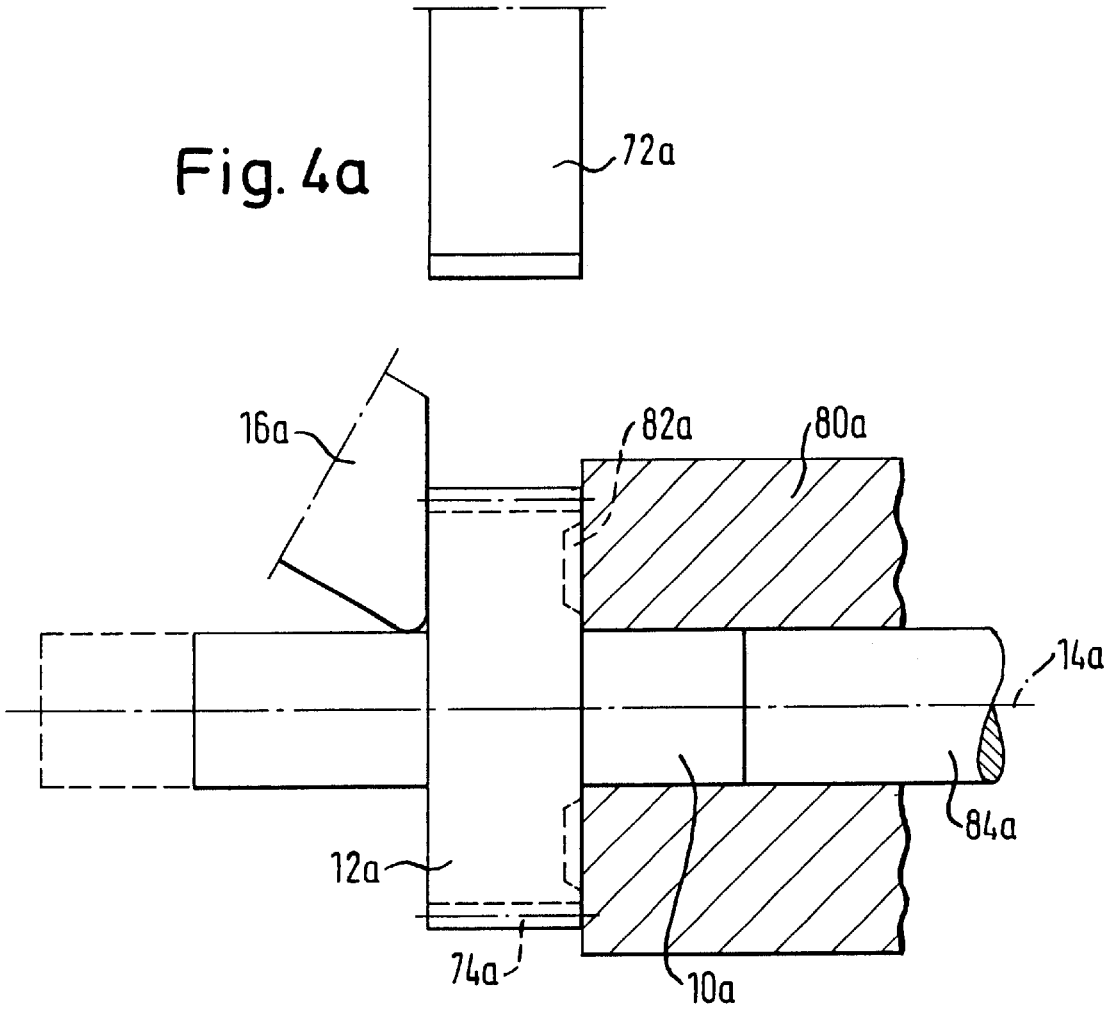
FIG. 4*a* illustrates a modification of the second embodiment, in which radial serrations are also made.

A variant of the method of FIG. 4 is shown in FIG. 4*a*. FIG. 4*a* shows a method for forming a frontal profiling 82*a* on the flange to be constructed. On one side of the flange is an annular, axially displaceable spinning tool 80*a*. The spinning tool 80*a* is pressed axially against the flange and in combination with the compressive force of the spinning roll 16*a* and the axial upsetting movement, a desired profiling is formed in a radially directed side of the flange. An ejector 84 is also provided permitting the separation of the workpiece from the annular spinning tool 80*a* following the working process.

Figure 5A:
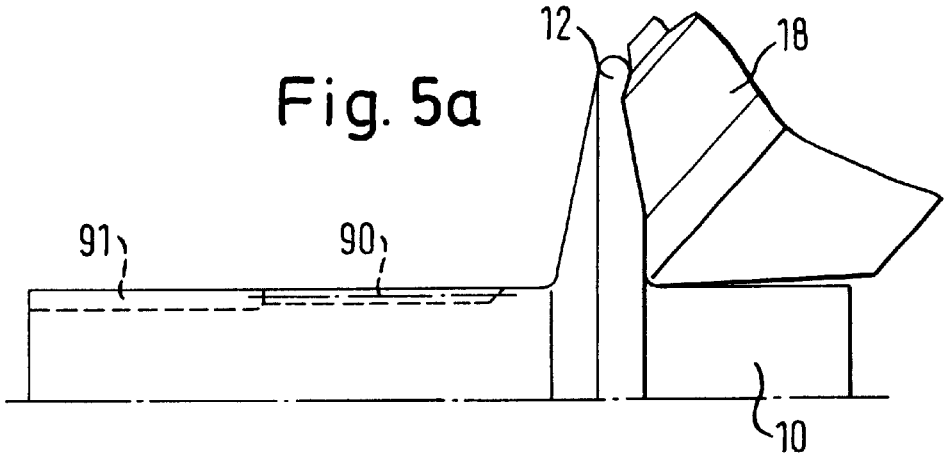
FIG. 5 shows a different forming alternatives in the manufacture of a shaft 5*b* and 5*c* with flange.

FIGS. 5*a, b* and *c* show different working or shaping alternatives in the production of a shaft with flange. In the embodiment according to FIG. 5*a* external teeth 90 are formed on the shaft and, as a function of the particular application, the teeth 90 can extend up to the shaft end or only be formed in a central part. In the latter case it can, for example, be necessary in the manufacture of a spline shaft profile, to remove by cutting or non-cutting procedures a material area 91 between the shaft end and the teeth 90.

Figure 5B:
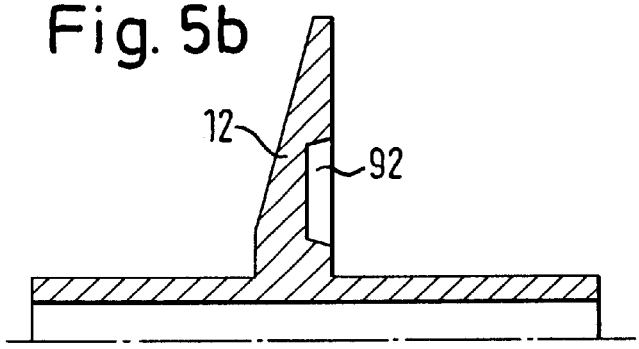

In the embodiment according to FIG. 5*b* a recess 92 is formed in flange 12. As a result of this material recess a gear part with a minimum mass moment of inertia is produced, as is desired for many applications.

Figure 5C:
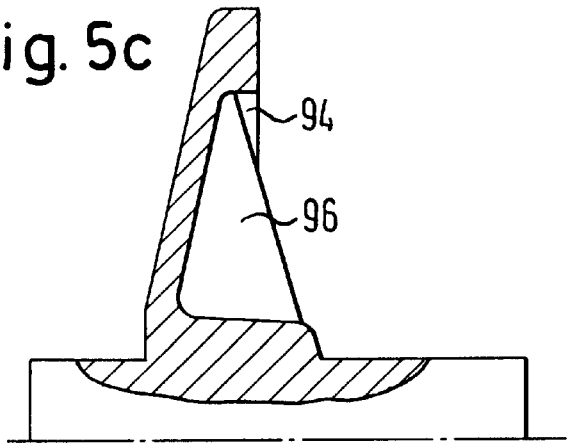

A further improvement with regards to the mass moment of inertia and for obtaining a particularly light workpiece structure is provided in another embodiment according to FIG. 5*c* through having a particularly deep, annular recess 94 in which are located stiffening ribs 96. The stiffening ribs 96 are formed without cutting during the hot forming of the flange by a device similar to that of FIG. 4*a*.

Figure 6:
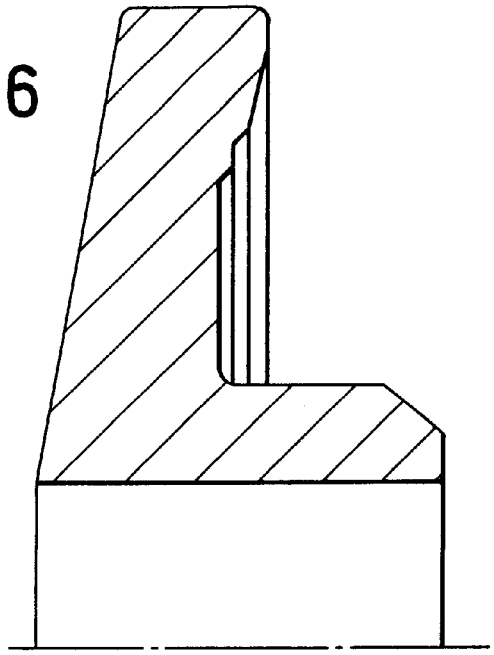
FIG. 6 shows the intermediate stage of a workpiece for the manufacture of a displaceable conical pulley element.
Figure 7:
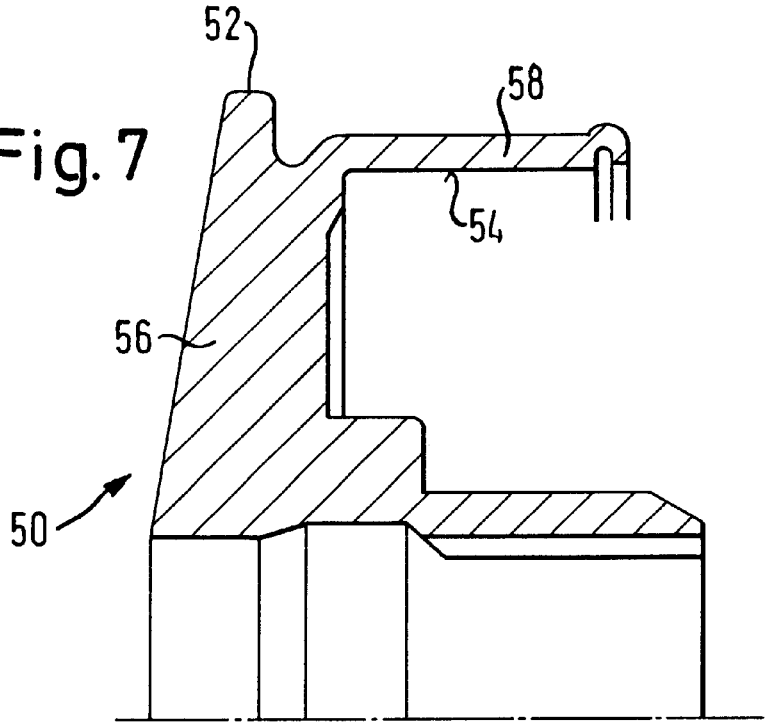
FIG. 7 A displaceable conical pulley element.

FIG. 6 shows a workpiece from which can be produced a displaceable conical pulley element according to FIG. 7. This workpiece was, for example, produced by a flow-forming process, in that an externally contoured spinning roll was infed from the right-hand side. This process can take place without or with a heat supply. The displaceable conical pulley element 50 shown in FIG. 7 has a sleeve-like hub section 52 with an internal contour 54, which can have a very varied design as a function of the intended use. The cylindrical circumferential wall section 58 of the sleeve-like hub section 52 was produced by a splitting-upsetting process. As material for the cylindrical circumferential wall section 58, material from the outer circumference of the conical pulley section 56 was brought to the desired shape by splitting and upsetting.

The features of the invention disclosed in the description, drawings and claims can be essential to the implementation of the invention either individually or in random combination.

What is claimed is:

1. Method for the manufacture of a flange for a shaft which comprises:

rotating a substantially round stock as a metal workpiece about a longitudinal axis thereof relative to at least one spinning roll and forming at least one flange having a larger diameter than remaining portions of the workpiece such that the workpiece is axially upset during rotation, displacing material of the workpiece during axial upsetting; and radially spinning the material under the action of at least one spinning roll;

wherein forming of the workpiece includes infeeding the workpiece by spinning rolls which are axially spaced from one another and the forming of said at least one flange comprises forming said at least one flange between the two spinning rolls and mutually controlling the axial upsetting and infeeding movements of the spinning rolls in a matched manner.

2. Method according to claim 1, which comprises heating the metal workpiece in an area in which the flange is formed to a temperature above a recrystallization point thereof.

3. Method according to claim 1, wherein the infeeding of the rolls comprises infeeding spinning rolls wherein at least one of said spinning rolls having a first shoulder face engaging the workpiece on a substantially axially directed outer circumference thereof and a second shoulder face which is substantially radially positioned with respect to the flange to be formed.

4. Method according to claim 1, wherein the infeeding of said spinning rolls comprises infeeding at least one pair of spinning rolls used in which at least one of said spinning rolls has an approximately disk-like shape or sleeve-like construction and which comprises infeeding said at least one spinning roll such that a roll used thereof is parallel to the longitudinal axis of the metal workpiece.

5. Method according to claim 1, which comprises infeeding the two spinning rolls such that the rolls are axially infed against one another for forming the flange.

6. A flange for a shaft of a cone gear manufactured according to the method of claim 1.

* * * * *